US010631072B2

(12) United States Patent
Starnes et al.

(10) Patent No.: US 10,631,072 B2
(45) Date of Patent: Apr. 21, 2020

(54) ACTUATOR FOR DISTRIBUTED MODE LOUDSPEAKER WITH EXTENDED DAMPER AND SYSTEMS INCLUDING THE SAME

(71) Applicant: Google LLC, Mountain View, CA (US)

(72) Inventors: Mark William Starnes, Sunnyvale, CA (US); Jonathan James Barrett, Cambridge (GB)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/017,383

(22) Filed: Jun. 25, 2018

(65) Prior Publication Data

US 2019/0394549 A1 Dec. 26, 2019

(51) Int. Cl.

| | |
|---|---|
| ***H04R 7/04*** | (2006.01) |
| ***H04R 1/02*** | (2006.01) |
| ***H04R 1/28*** | (2006.01) |

(52) U.S. Cl.

CPC ..... *H04R 1/028* (2013.01); *H04R 1/2811* (2013.01); *H04R 2499/15* (2013.01)

(58) Field of Classification Search

CPC ..... H04R 7/04; H04R 7/045; H04R 17/00; H04R 17/005

See application file for complete search history.

(56) References Cited

U.S. PATENT DOCUMENTS

| | | | | |
|---|---|---|---|---|
| 7,151,837 | B2 * | 12/2006 | Bank | H04R 7/045 381/190 |
| 7,180,225 | B2 * | 2/2007 | Sashida | B06B 1/0611 310/330 |
| 7,475,598 | B2 * | 1/2009 | Starnes | G01L 1/10 181/157 |

(Continued)

FOREIGN PATENT DOCUMENTS

| | | | | |
|---|---|---|---|---|
| JP | 2011155397 A | * | 8/2011 | H01L 41/053 |
| JP | 2013229800 | | 9/2013 | |
| WO | WO-2017145649 A1 | * | 8/2017 | H04R 7/04 |

OTHER PUBLICATIONS

PCT International Search Report and Written Opinion in International Appln. No. PCT/GB2019/051787, dated Sep. 23, 2019, 17 pages.

*Primary Examiner* — Fan S Tsang
*Assistant Examiner* — Ryan Robinson
(74) *Attorney, Agent, or Firm* — Fish & Richardson P.C.

(57) ABSTRACT

A system includes a panel extending in a plane, an actuator attached to a surface of the panel, and an electronic control module to activate the actuator to cause vibration of the panel. The actuator includes: a plate to create a force to cause vibration of the panel to generate sound waves, having a width, $W_T$, at a first edge; a stub extending from the first edge of the plate, having a width at a region of connection to the plate that is less than $W_T$, the stub being attached to the surface of the panel to transfer the force received from the plate to the panel and cause the panel to vibrate; and a (Continued)

damper supported by a surface of the plate facing the panel coupling the plate to the panel, the damper having a having a width greater than $W_S$.

21 Claims, 7 Drawing Sheets

(56) References Cited

U.S. PATENT DOCUMENTS

| | | | | |
|---|---|---|---|---|
| 7,750,540 | B2 * | 7/2010 | Sasaki | B06B 1/0603 310/330 |
| 7,764,804 | B2 * | 7/2010 | Ohta | H04R 17/00 381/152 |
| 8,680,746 | B2 * | 3/2014 | Takahashi | H04R 17/00 310/323.02 |
| 9,215,531 | B2 * | 12/2015 | Nakamura | H04R 1/00 |
| 9,226,077 | B2 * | 12/2015 | Kong | H04R 17/00 |
| 9,774,958 | B2 * | 9/2017 | Zaitsu | H04R 7/045 |
| 10,079,925 | B2 * | 9/2018 | Hosoi | H04M 1/6066 |
| 2001/0055403 | A1 | 12/2001 | Bachmann et al. | |
| 2003/0193270 | A1 * | 10/2003 | Hyun | H01L 41/053 310/348 |
| 2006/0140424 | A1 * | 6/2006 | Kobayashi | H04R 7/045 381/190 |
| 2007/0053531 | A1 | 3/2007 | Ohta et al. | |
| 2009/0045700 | A1 | 2/2009 | Sasaki et al. | |
| 2013/0043766 | A1 | 2/2013 | Takahashi et al. | |
| 2015/0243874 | A1 | 8/2015 | East et al. | |
| 2019/0027678 | A1 * | 1/2019 | Kishimoto | H01L 41/187 |

* cited by examiner

ACTUATOR FOR DISTRIBUTED MODE LOUDSPEAKER WITH EXTENDED DAMPER AND SYSTEMS INCLUDING THE SAME

BACKGROUND

Many conventional loudspeakers produce sound by inducing piston-like motion in a diaphragm. Panel audio loudspeakers, such as distributed mode loudspeakers (DMLs), in contrast, operate by inducing uniformly distributed vibration modes in a panel with an electro-acoustic actuator. For instance, a smartphone may include a DMA that applies force to a display panel (e.g., a LCD or an OLED panel) in the smartphone. The force creates vibrations of the display panel that couple to surrounding air to generate sound waves, e.g., in the range of 20 Hz to 20 kHz which may be audible to a human ear.

SUMMARY

A two-dimensional distributed mode actuator may generate force in multiple dimensions to provide a system that includes the actuator, such as a smartphone, a wider output frequency range, a reduced actuator length, or both, compared to single-dimensional distributed mode actuators that generate force in a single direction, e.g., along a length of the single-dimensional actuator. For instance, the two-dimensional actuator may generate separate forces along a length and a width of the actuator and transfer these forces to a load, such as a speaker, to cause the load to generate sound. The two-dimensional distributed mode actuator also has different vertical, e.g., height, displacement along the width of the actuator, while a single-dimensional actuator generally has constant vertical displacement along with width.

Typically, a two-dimensional distributed mode actuator includes a plate connected to a stub. The plate has a width and a length that define a surface that generates force for the two-dimensional distributed mode actuator. The stub connects the plate to the panel, while at least one end of the plate along its width and its length are free to vibrate.

When the two-dimensional distributed mode actuator receives a drive signal, the two-dimensional distributed mode actuator can cause different sections of the plate's surface to move separately along a height axis. The height axis is perpendicular to the axes for the length and the width of the actuator.

The actuator also includes a damper that fits between a space between the plate's surface and the panel. As the plate vibrates it compresses the damper against the panel, absorbing vibration energy from the plate and changing the response of the actuator. It is believe that extending the damper along the width of the plate beyond the stub can improve the performance of the actuator-panel system at certain frequencies. For example, extending the damper's width can mitigate cancellation of output at frequencies between 5 kHz and 10 kHz in certain applications that has been observed for actuators having dampers that don't extend beyond the width of the stub.

Various aspects of the invention are summarized as follows.

In general, in a first aspect, the invention features a system that includes a panel extending in a plane, an actuator attached to a surface of the panel, and an electronic control module in electrical communication with the actuator and programmed to activate the actuator during operation of the system to cause the vibration of the panel. The actuator includes: a plate adapted to create a force to cause vibration of the panel to generate sound waves, the plate having a width, $W_T$, along a first direction at a first edge of the plate and a length, $L_T$, along a second direction orthogonal to the first direction, the first and second directions being parallel to the plane, the plate having a first edge extending along the first direction; a stub extending from the first edge of the plate, the stub having a width, $W_S$, in the first direction at a region of connection to the plate that is less than $W_T$, the stub being attached to the surface of the panel to transfer the force received from the plate through to the panel and cause the panel to vibrate; and a damper supported by a surface of the plate facing the panel, the damper coupling the plate to the panel, the damper having a having a width, $W_D$, extending in the first direction by an amount greater than $W_S$.

Embodiments of the system can include one or more of the following features and/or features of other aspects. For example, the force created by the plate can include a fundamental resonance peak at a first frequency, $F_0$, a first resonance peak at a first frequency, $F_1$, and a second resonance peak at a second frequency, $F_2$, wherein an output of the plate is increased for at least some frequencies between $F_1$ and $F_2$ compared to the same plate but for which $W_D$ is the same as $W_S$. For at least one frequency between $F_1$ and $F_2$, the force created by the plate can be at least 50 times greater (e.g., 60 times or more, 75 times or more, 100 times or more) compared to the same plate but for which $W_D$ is the same as $W_S$. $F_0$ can be in a range from about 300 Hz to about 1 kHz and $F_1$ can be in a range from about 3 kHz to about 8 kHz.

A center point of the region of attachment of the stub to the plate can be offset from a center point of the first edge of the plate. The region of connection of the stub to the first edge of the plate extends from a corner of the plate.

$W_D$ can be about 50% of $W_T$ or more (e.g., about 60% or more, about 70% or more, about 80% or more, about 90% or more). In some embodiments, $W_D$ is substantially the same as $W_T$.

$W_S$ can be about 50% of $W_T$ or less (e.g., about 35% or less, about 30% or less, about 25% or less).

The damper can have a length along the second direction, $L_D$, substantially less than $L_T$.

The plate can include a piezoelectric material.

The actuator, at a second edge of the plate opposite the first edge, can be unattached to the panel. In some embodiments, the plate can include a third edge extending along the second direction and a fourth edge opposite the third edge, wherein the actuator is unattached to the panel along the third and fourth edges.

The surface of the plate can face the surface of the panel and extend parallel to the plane of the panel, and the stub can include a portion that extends away from the surface of the plate along a third direction orthogonal to the first and second directions, the portion of the stub providing a separation between the surface of the plate and the surface of the panel. The damper can have a thickness in the third direction substantially equal to the separation between the surface of the plate and the surface of the panel. The separation between the surface of the panel and the surface of the plate can be in a range from about 0.2 mm to about 5 mm.

The panel can include an electronic display panel.

In general, in another aspect, the invention features a distributed mode actuator, including: a plate adapted to create a force to cause vibration of a load to generate sound waves, the plate having a width, $W_T$, along a first direction at a first edge of the plate and a length, $L_T$, along a second direction orthogonal to the first direction, the first and second directions being parallel to the plane, the plate having a first edge extending along the first direction; a stub extending from the first edge of the plate, the stub having a width, $W_S$, in the first direction at a region of connection to the plate that is less than $W_T$, the stub being attachable to the load to transfer the force received from the plate through to the load and cause the load to vibrate; and a damper supported by a surface of the plate facing the load when the stub is attached to the load, the damper coupling the plate to the panel, the damper having a having a width, $W_D$, extending in the first direction by an amount greater than $W_S$, the damper being formed from a material having viscoelastic properties to damp vibrations of the load.

Embodiments of the distributed mode actuator can include one or more features of other aspects.

In general, in a further aspect, the invention features a mobile device (e.g., a mobile phone), including an electronic display panel extending in a plane, a chassis attached to the electronic display panel and defining a space between a back panel of the chassis and the electronic display panel, an electronic control module housed in the space, the electronic control module including a processor; and an actuator housed in the space and attached to a surface of the electronic display panel. The actuator includes: a plate adapted to create a force to cause vibration of the electronic display panel to generate sound waves, the plate having a width, $W_T$, along a first direction at a first edge of the plate and a length, $L_T$, along a second direction orthogonal to the first direction, the first and second directions being parallel to the plane, the plate having a first edge extending along the first direction; a stub extending from the first edge of the plate, the stub having a width, $W_S$, in the first direction at a region of connection to the plate that is less than $W_T$, the stub being attached to the surface of the electronic display panel to transfer the force received from the plate through to the electronic display panel and cause the electronic display panel to vibrate; and a damper supported by a surface of the plate facing the electronic display panel, the damper coupling the plate to the electronic display panel, the damper having a having a width, $W_D$, extending in the first direction by an amount greater than $W_S$. The electronic control module is in electrical communication with the actuator and programmed to activate the actuator during operation of the mobile device to cause the vibration of the electronic display panel.

Embodiments of the mobile device can include one or more features of other aspects.

Among other advantages, embodiments feature 2D DMA's that display improved output at certain frequency bands compared to similar actuator's that feature shortened dampers. The frequency response of the actuator, and precise range of improved output, can be varied depending on design parameters of the system, such as the physical dimensions of each component and each components material properties. Accordingly, device performance can be improved (e.g., optimized) by judicious selection of the damper's dimensions and material properties.

Other advantages will be evident from the description, drawings, and claims.

BRIEF DESCRIPTION OF THE DRAWINGS

Like reference symbols in the various drawings indicate like elements.

DETAILED DESCRIPTION

The disclosure features actuators for panel audio loudspeakers, such as distributed mode loudspeakers (DMLs). Such loudspeakers can be integrated into a mobile device, such as a mobile phone. For example, referring to FIG. 1, a mobile device 100 includes a device chassis 102 and a touch panel display 104 including a flat panel display (e.g., an OLED or LCD display panel) that integrates a panel audio loudspeaker. Mobile device 100 interfaces with a user in a variety of ways, including by displaying images and receiving touch input via touch panel display 104. Typically, a mobile device has a depth of approximately 10 mm or less, a width of 60 mm to 80 mm (e.g., 68 mm to 72 mm), and a height of 100 mm to 160 mm (e.g., 138 mm to 144 mm).

Mobile device 100 also produces audio output. The audio output is generated using a panel audio loudspeaker that creates sound by causing the flat panel display to vibrate. The display panel is coupled to an actuator, such as a two-dimensional distributed mode actuator, or 2D DMA. The actuator is a movable component arranged to provide a force to a panel, such as touch panel display 104, causing the panel to vibrate. The vibrating panel generates human-audible sound waves, e.g., in the range of 20 Hz to 20 kHz.

In addition to producing sound output, mobile device 100 can also produces haptic output using the actuator. For example, the haptic output can correspond to vibrations in the range of 180 Hz to 300 Hz.

Figure 1:
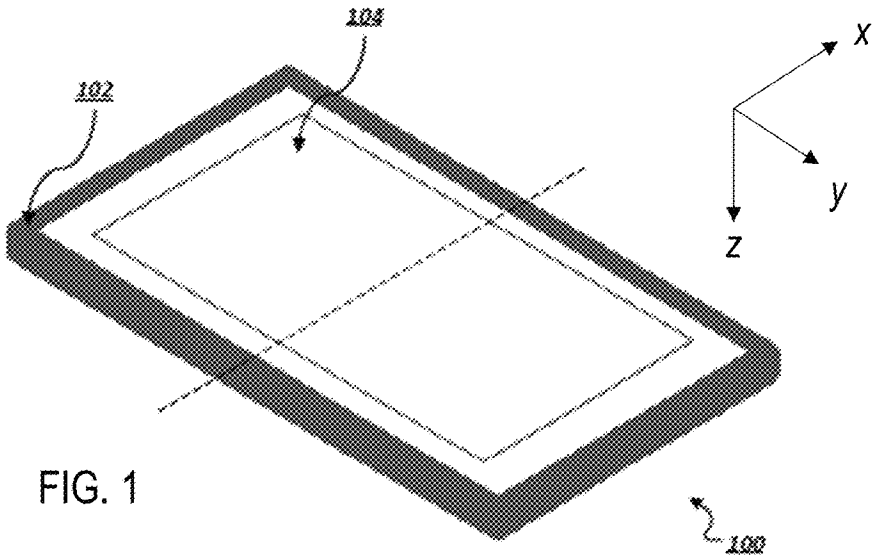
FIG. 1 is a perspective view of an embodiment of a mobile device.
Figure 2:
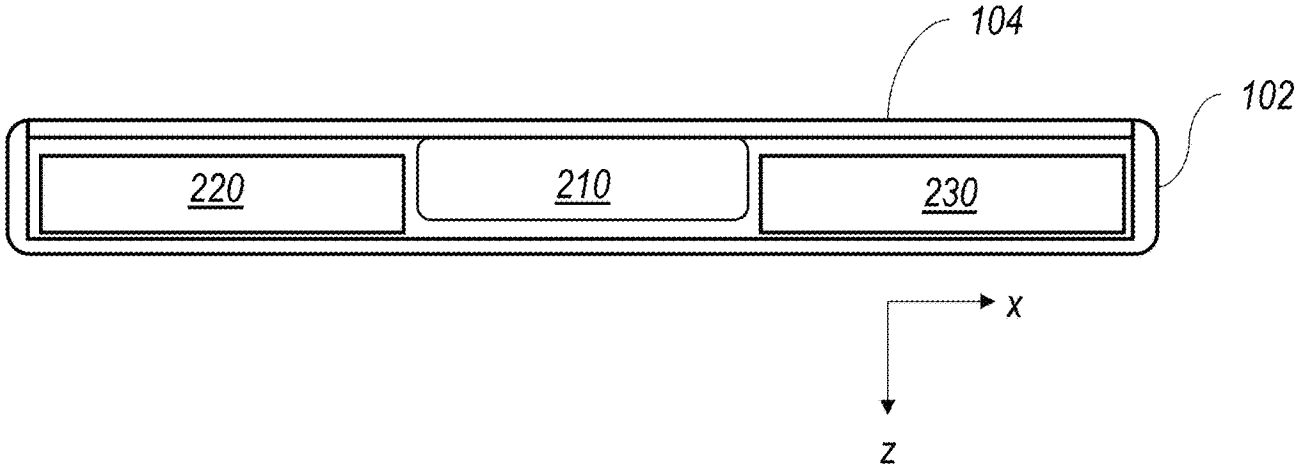
FIG. 2 is a schematic cross-sectional view of the mobile device of FIG. 1.

FIG. 1 also shows a dashed line that corresponds to the cross-sectional direction shown in FIG. 2. Referring to FIG. 2, a cross-section 200 of mobile device 100 illustrates device chassis 102 and touch panel display 104. FIG. 2 also includes a Cartesian coordinate system with X, Y, and Z axes, for ease of reference. Device chassis 102 has a depth measured along the Z-direction and a width measured along the X-direction. Device chassis 102 also has a back panel, which is formed by the portion of device chassis 102 that extends primarily in the X-Y-plane. Mobile device 100 includes an electromagnet actuator 210, which is housed behind display 104 in chassis 102 and affixed to the back side of display 104. Generally, electromagnet actuator 210 is sized to fit within a volume constrained by other components housed in the chassis, including an electronic control module 220 and a battery 230.

Figure 3:
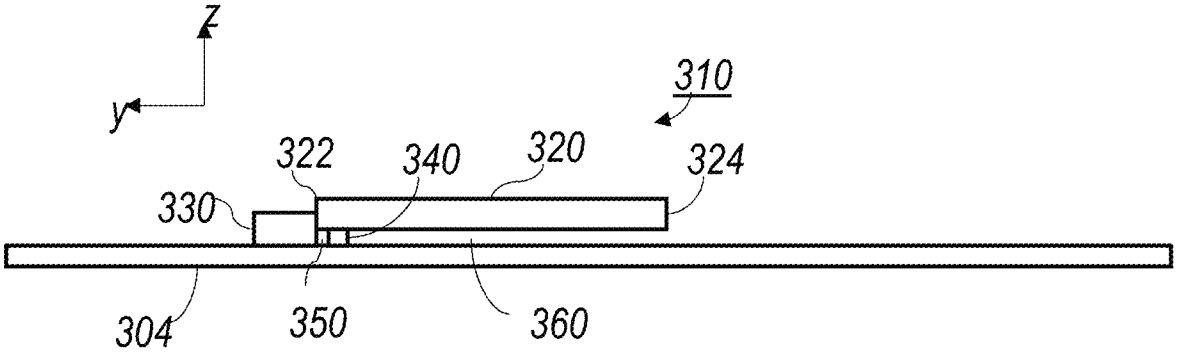
FIG. 3 is a side view of an example of a 2D distributed mode actuator (DMA) attached to a panel

Referring to FIG. 3, an embodiment of a 2D DMA 310 includes a plate 320 that extends along the y-direction from a free end 324 to an end 322 connected to a stub 330. Stub 330 is attached to a surface of a display panel 304. Effectively, plate 320 is a cantilever, anchored at a corner to stub 330. DMA 310 also includes a damper 340 that is attached to a surface of plate 320 facing display panel 304. A space 360 is provided between plate 320 and display panel 304, extending from damper 340 to free end 324.

Figure 4A:
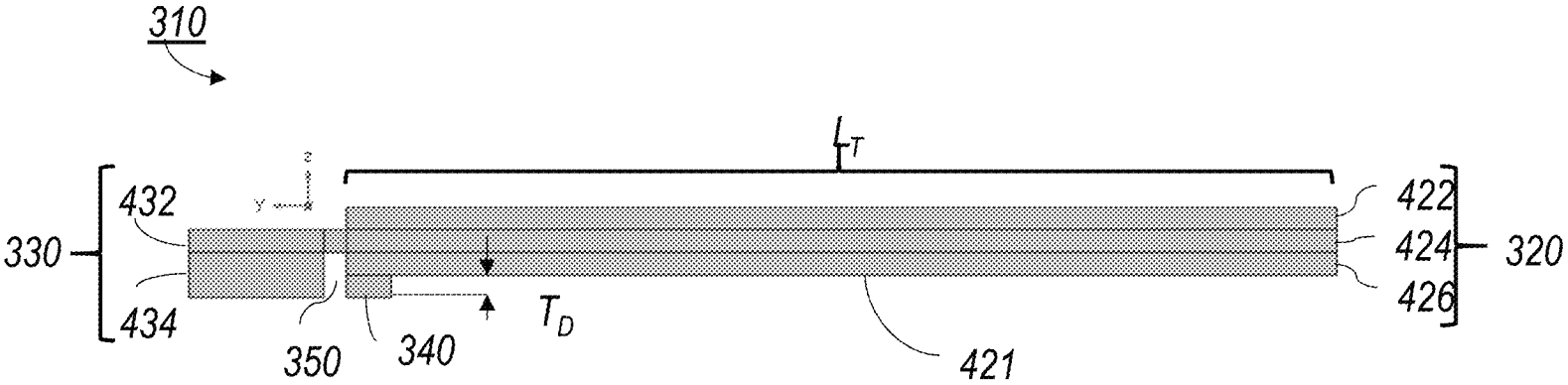
FIGS. 4A-4C are a side, isometric, and top view of the 2D DMA shown in FIG. 3.
Figure 4C:
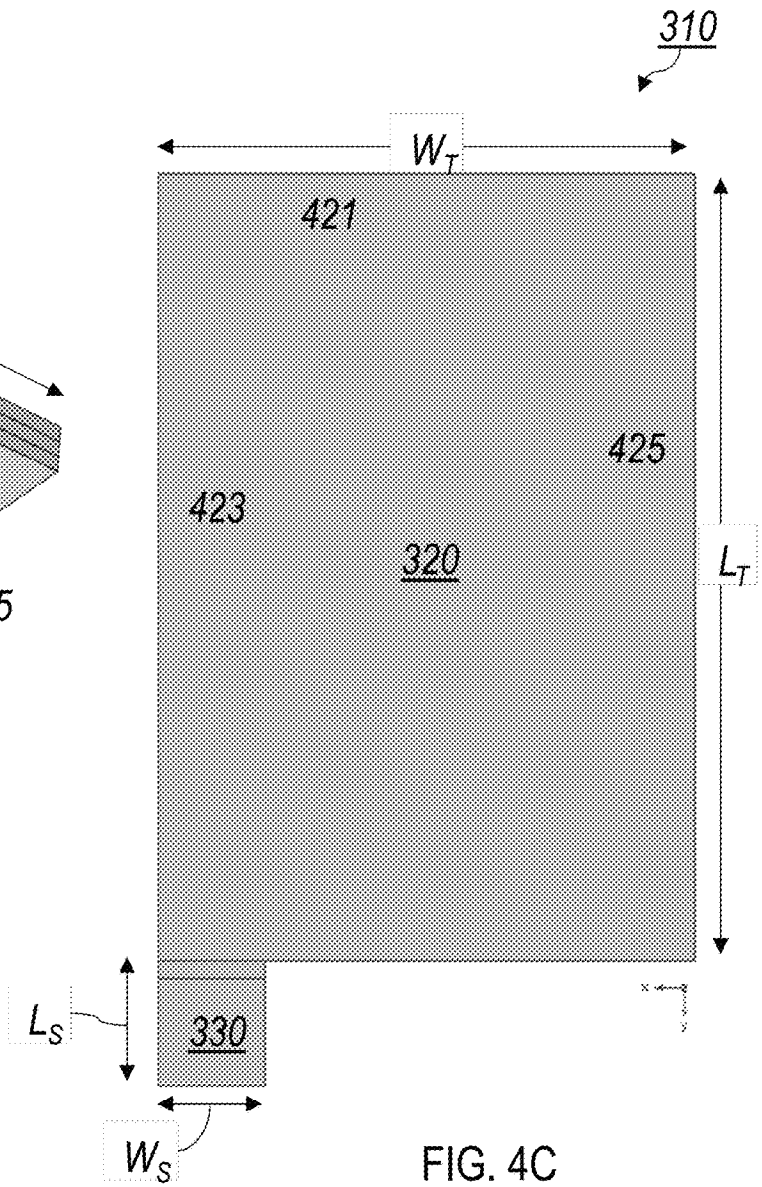
Figure 4B:
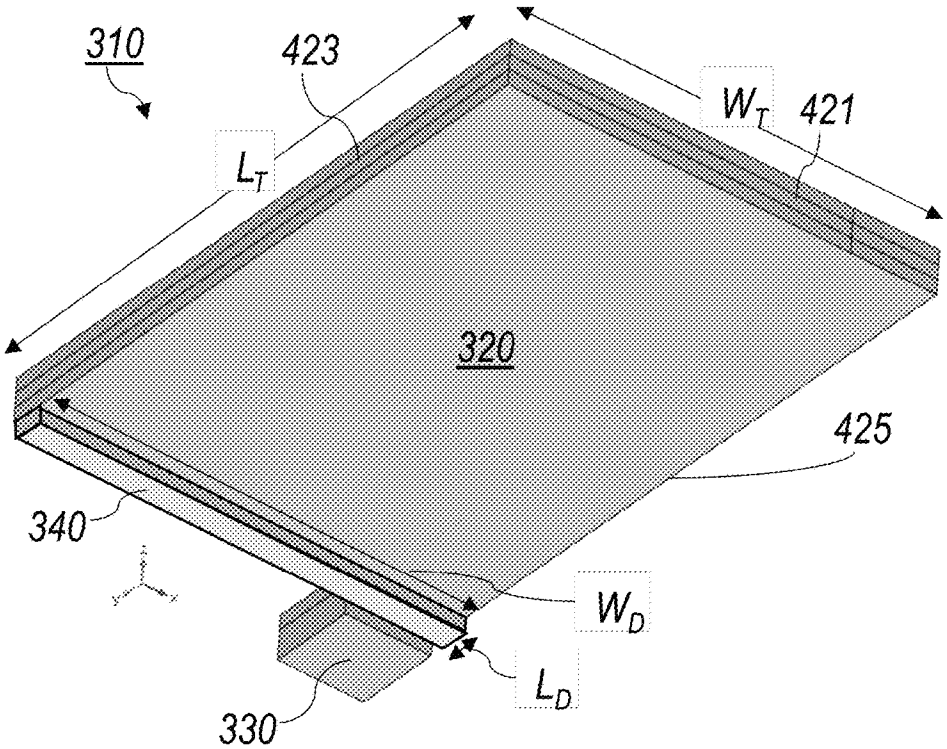
Figure 5:
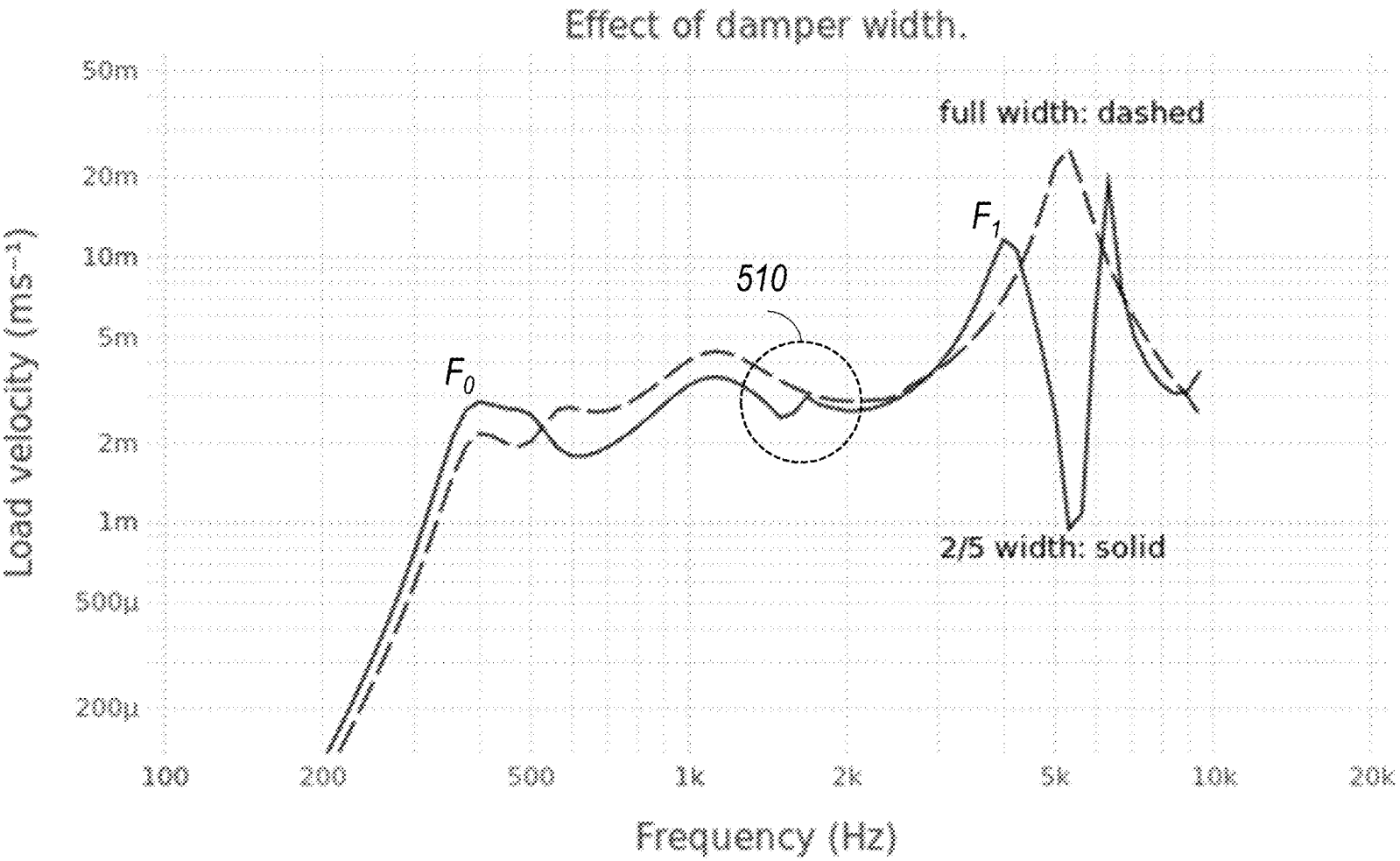
FIG. 5 is a plot of load velocity as a function of frequency comparing the effect of a damper that is ⅖ the width of the plate (solid line) to one that is the full width of the plate (dashed line).

FIGS. 4A-4C depict DMA 310 in more detail. Specifically, FIG. 4A shows a side view of DMA 310, FIG. 4B shows an isometric view, and FIG. 4C shows a plan view. Plate 320 has a rectangular shape, extending a length, $L_T$, along the y-direction and a width, $W_T$, in the x-direction.

Plate 320 is a multilayer planar element, composed of layers 422, 424, and 426, having a rectangular shape in the x-y plane, with a length $L_T$ and a width $W_T$ in the y- and x-directions, respectively. Generally, the length and width of plate 320 is selected, along with the mechanical properties of its compositional materials, so that the plate has vibrational resonances at frequencies appropriate for the application for which it is being used. Also, the dimensions can depend on the amount of space available for the plate in device 100. In some embodiments, $L_T$ and $W_T$ are in a range from about 1 cm to about 5 cm. $L_T$ can be larger than $W_T$.

Layer 422, 424, and 426 generally include at least one layer of an appropriate type of piezoelectric material. For instance, one or more of these layers can be a ceramic or crystalline piezoelectric material. Examples of ceramic piezoelectric materials include barium titanate, lead zirconium titanate, bismuth ferrite, and sodium niobate, for example. Examples of crystalline piezoelectric materials include topaz, lead titanate, lithium niobate, and lithium tantalite. In some embodiments, layers 422 and 426 are piezoelectric materials while layer 424 is a rigid vane formed from, e.g., a rigid metal or rigid plastic. Layer 424 can extend into stub 330, severing as a cantilever for plate 320.

In some embodiments, plate 320 can be composed of additional layers. For instance, each piezoelectric layer can, itself, be composed of two more sublayers.

Generally, the thickness of plate 320 in the z-direction can vary depending on the desired mechanical properties the plate. In some embodiments, plate 320 has a thickness in a range from about 0.5 mm to about 5 mm (e.g., about 1 mm or more, about 1.5 mm or more, about 2 mm or more, about 2.5 mm or more, about 4 mm or less, about 3.5 mm or less, about 3 mm or less). The layer thickness of layers 422, 424, and 426 can vary as desired. For example, each layer have a thickness in a range of about 0.1 mm to about 2 mm (e.g., about 0.2 mm or more, about 0.5 mm or more, about 1.5 mm or less, about 1 mm or less).

Plate 320 is anchored to stub 330 along a portion of edge 322 of plate 320. Stub 330 is mechanically secured to panel 304 at one end and to plate 320 at another end sufficient that the stub can efficiently transfer force from the plate to the panel. Stub 330 includes a portion 434 that extends in the z-direction beyond the surface of plate 320 toward panel 304. This establishes the extent of space 360 between panel 304 of plate 320. In some embodiments, space 360 is in a range from about 0.2 mm to about 3 mm (e.g., about 0.5 mm or more, about 1 mm or more, about 2 mm or less).

Stub 330 has a length, $L_S$, in the y-direction and a width, $W_S$, in the x-direction. $W_S$ is generally significantly smaller than $W_T$, the plate's width, so that a significant portion of the plate along edge 322 is free to vibrate when activated. In some embodiments, $W_S$ is less than 50% of $W_T$ (e.g., about 40% or less, about 35% or less, about 30% or less, about 25% or less, about 20% or less, about 15% or less). Because none of the other edges of plate 320 are anchored to the panel, they too are free to vibrate when the plate is activated. Accordingly, plate 320 can support vibrational modes in both the x- and y-directions.

Panel 304 may be permanently, e.g., fixedly, connected to stub 330, e.g., such that removal of panel 304 from stub 330 will likely damage panel 304, stub 330, or both. In some examples, panel 304 is removably connected to stub 330, e.g., such that removal of panel 304 from stub 330 will not likely damage panel 304 or stub 330. In some embodiments, an adhesive is used to connect a surface of stub 330 to panel 304.

Stub 330 is typically formed from a hard material, e.g., that does not deform. For example, stub 330 may be formed from a metal, a hard plastic, or another appropriate type of material. In some embodiments, stub 330 is a composite structure, formed from two or more pieces of different materials.

Damper 340 is supported by the surface of plate 320 facing panel 304. The damper has a thickness, TD, sufficient so that it contacts the surface of panel 304, thereby providing a mechanical coupling between plate 320 and panel 304. Damper 340 has a width, $W_D$, extending in the x-direction greater than $W_S$ and approximately equal to $W_T$. Damper 340 has a length along the y-direction, $L_D$, substantially less than $L_T$. For example, $L_D$ can be about 20% of $L_T$ or less (e.g., about 15% or less, about 10% or less, about 8% or less, about 5% or less).

Damper 340 is typically formed from one or more materials that have viscoelastic properties suitable for damping vibrations at certain frequencies. The damper materials should also be sufficiently environmentally robust so as not to degrade substantially during the lifetime of the DMA. Suitable materials can include organic or silicone polymers, e.g., rubbers. In some embodiments, neoprene is used. Commercially-available adhesive tapes, such as Tesatape (from Tesa Tape Inc., Charlotte, N.C.), can be used in certain embodiments.

While actuator 310 includes a damper 340 that has the same width as plate 320 (i.e., $W_T$=$W_D$), other implementations are also possible. In general, while the width of damper 340 is greater than a width of stub 330, the width of the damper can vary. For example, $W_S$ can be about 50% of $W_D$ or less (e.g., about 45% of $W_D$ or less, about 40% of $W_D$ or less, about 35% of $W_D$ or less, about 30% of $W_D$ or less, about 25% of $W_D$ or less, about 20% of $W_D$ or less, about 15% of $W_D$ or less). $W_D$ can be about 40% or more of $W_T$ (e.g., about 50% or more, about 60% or more, about 70% or more, about 80% or more, about 90% or more, such as about 100% of $W_T$). In general, the precise width of the damper can be included as a design variable in order to obtain a desired frequency response.

Furthermore, while the plate described above has a rectangular footprint in the x-y plane, more generally, other shapes are possible. For example, the dimension of the plate in either the x-direction and/or y-direction can vary along its length and width. Generally, the width of the plate is considered its maximum dimension in the x-direction, while the length of the plate is considered its maximum dimension in the y-direction. Similarly, either the stub and/or damper may have footprints that are not rectangular. In general, the shape of each of these element can be optimized, e.g., using computational simulation software, to a shape that provides a desired response spectrum.

In general, the force created by the plate includes a fundamental resonance peak at a first frequency, $F_0$, a first resonance peak at a first frequency, $F_1$, and a second resonance peak at a second frequency, $F_2$. These resonances represent frequencies at which the force amplitude, which is a measure of the output of the actuator, is a local maximum. Generally, for a fixed input power, the efficiency of the actuator will decrease between these resonances. For actuators designed to produce audio signals in a panel audio loudspeaker, such as actuator 310, $F_0$ is typically in a range from about 300 Hz to about 1 kHz (e.g., from about 400 Hz to about 600 Hz), $F_1$ is typically in a range from about 3 kHz to about 8 kHz (e.g., from about 4 kHz to about 6 kHz), and $F_2$ is typically in a range from about 10 kHz to about 20 kHz. These resonance frequencies depend on, among other parameters, on the width, $W_D$, of damper 340. It is believed that, by using a damper that extends beyond the width of the stub, an output of the plate is increased for at least some frequencies between $F_1$ and $F_2$ compared to the same plate but for which $W_D$ is the same as $W_S$. For at least one frequency between $F_1$ and $F_2$, the force created by the plate is at least 5 times (e.g., about 10 times or more, about 20 times or more, about 50 times or more) greater compared to the same plate but for which $W_D$ is the same as $W_S$.

Figure 6:
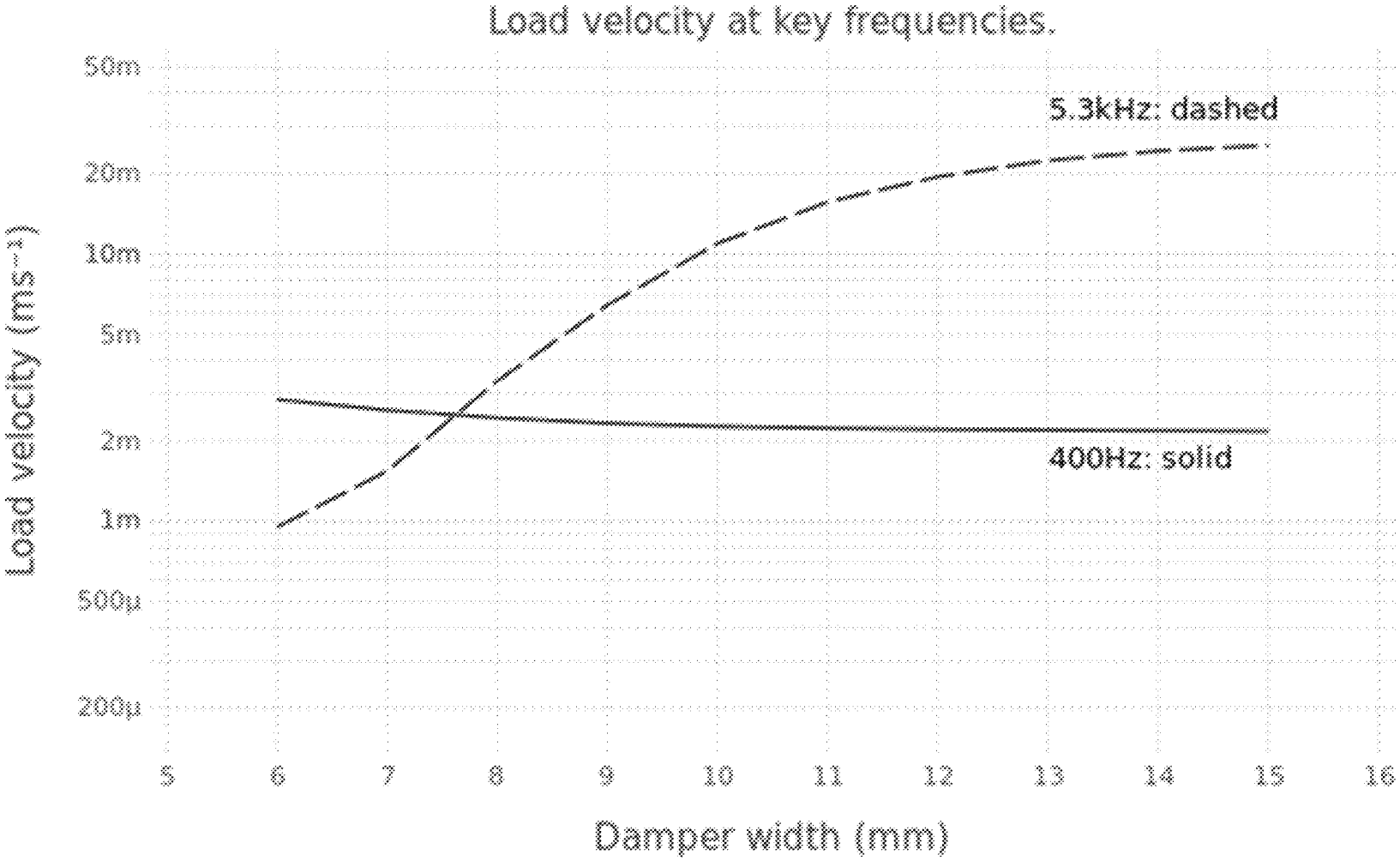
FIG. 6 is a plot of load velocity as a function of damper with at 400 Hz (solid line) and 5.3 kHz (dashed line).

FIG. 6 illustrate the effect of damper width on load velocity (in ms-1) at two different frequencies of interest, namely 400 Hz and 5.3 kHz. These results were generated by simulation. As is evident from this plot, low frequency performance (e.g., at 400 Hz) is relatively unchanged as the damper width is increased from 6 mm to 15 mm. At higher frequencies (5.3 kHz in this example), however, damper width has a significant impact on load velocity, increasing the velocity over an order of magnitude from a low value at 6 mm damper width, to a maximum value at 15 mm.

Figure 7:
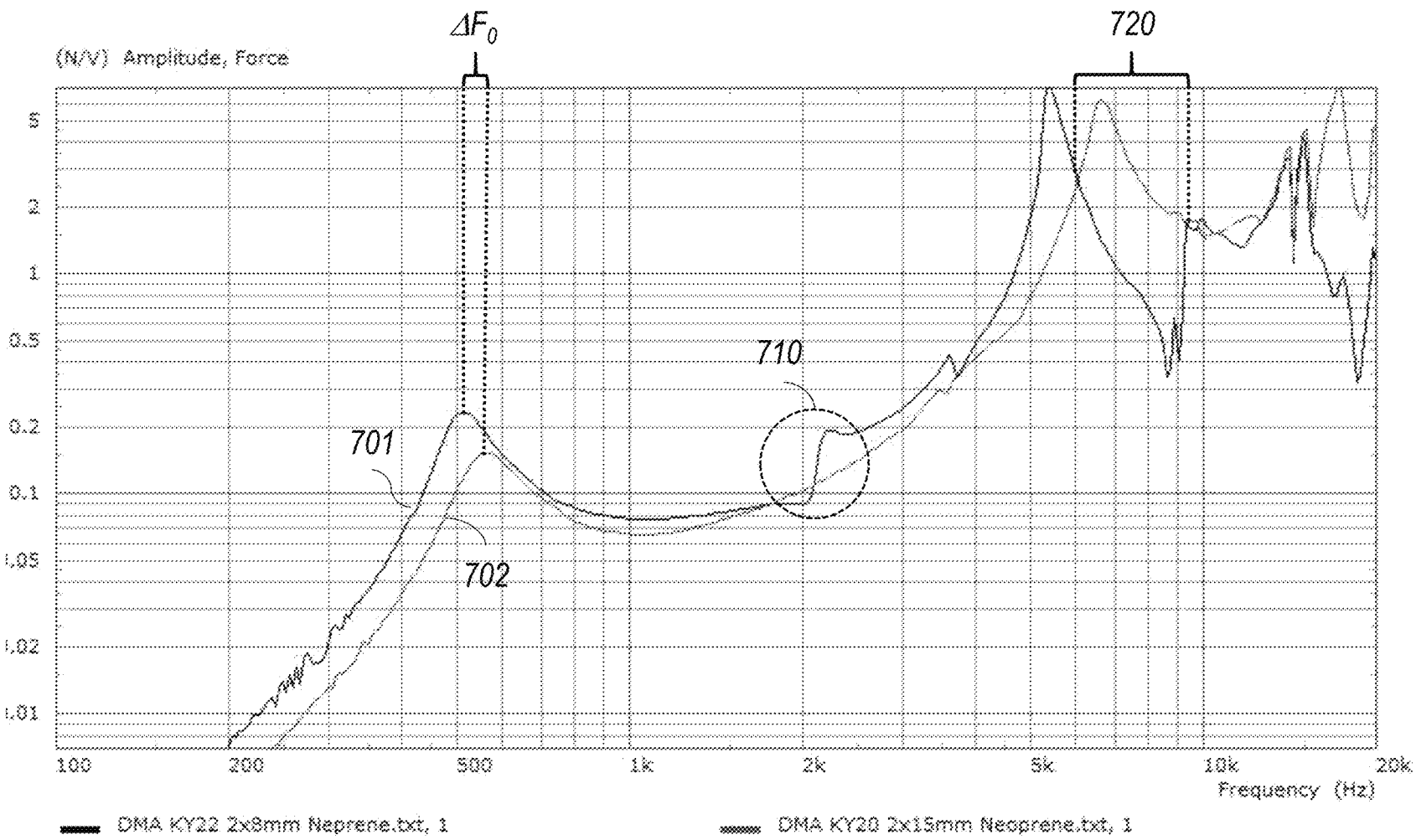
FIG. 7 is a plot comparing a measured force amplitude of a first DMA with a damper that is ⅖ the width of the plate and the force amplitude of a second DMA with a damper that is the full width of the plate.

FIG. 7 compares the performance of two DMA's having dampers with differing widths. Specifically, FIG. 7 shows a plot of results of a blocked force measurement taken for a DMA with a damper that has a width that is ⅖ the width of the plate (line 701) and measurements taken for a similar DMA in which the damper has a width that is substantially equal to the width of the plate (line 702). There are several notable differences between the two spectra. First, the DMA with the extended damper demonstrates a fundamental frequency $F_0$ at a slightly higher frequency than the DMA with the shorter damper. This frequency shift is identified as $\Delta F_0$ in FIG. 7, and is about 80 Hz. Second, the DMA with the shorter damper (line 701) exhibits a notable step in its spectra at approximately 2 kHz. This is identified as 710 in FIG. 7. The extended damper does not display such as step, but a much smoother increase in response from approximately 1 kHz to $F_1$. Third, at the frequency range 720, from approximately 6 kHz to 10 kHz, the DMA with the shorter damper exhibits a significant drop in force output over this range. In contrast, the drop in force output from the DMA with the extended damper is significantly smaller.

Figure 8:
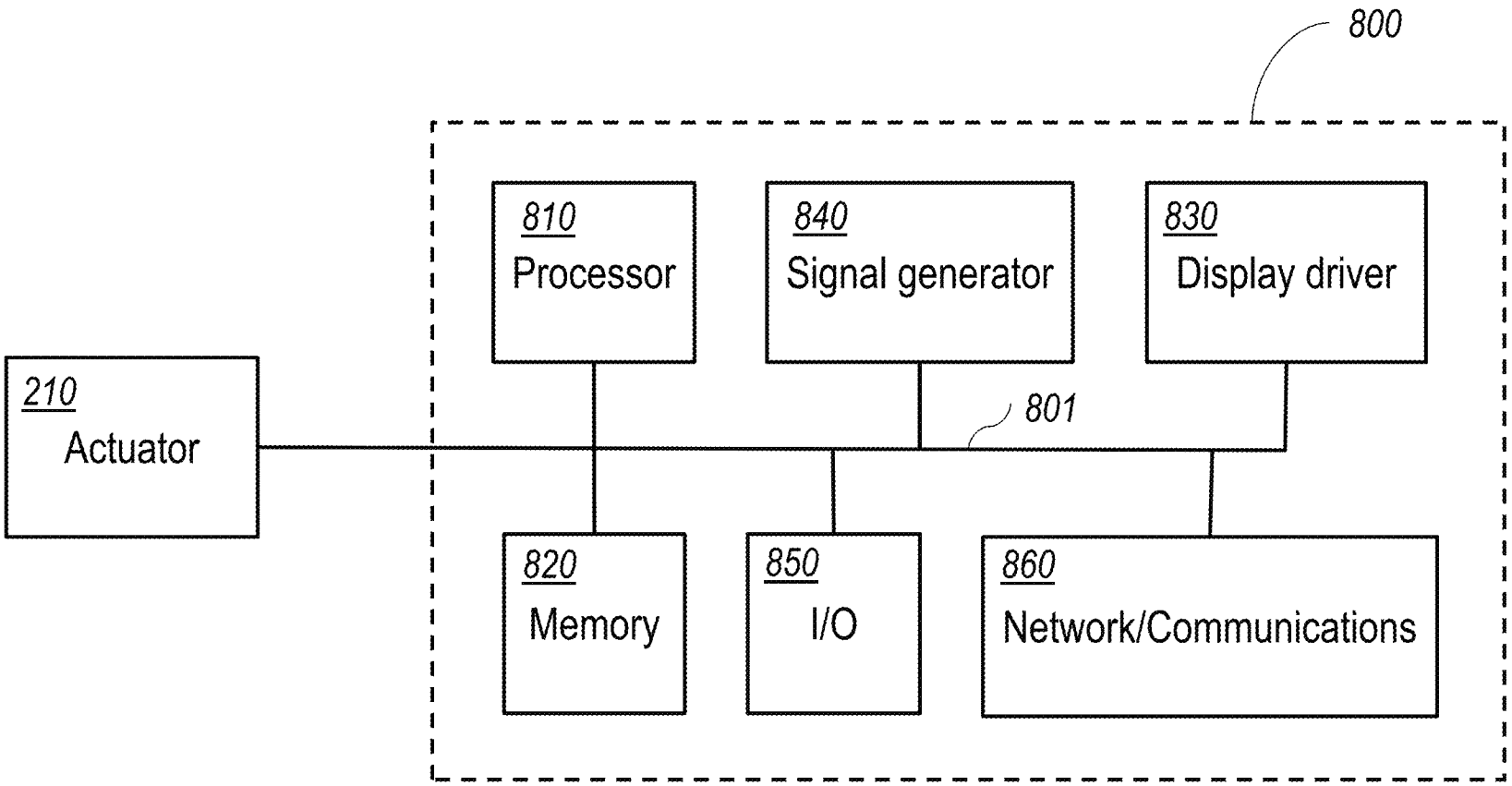
FIG. 8 is a schematic diagram of an embodiment of an electronic control module for a mobile device.

In general, the disclosed actuators are controlled by an electronic control module, e.g., electronic control module 220 in FIG. 2 above. In general, electronic control modules are composed of one or more electronic components that receive input from one or more sensors and/or signal receivers of the mobile phone, process the input, and generate and deliver signal waveforms that cause actuator 210 to provide a suitable haptic response. Referring to FIG. 8, an exemplary electronic control module 800 of a mobile device, such as mobile phone 100, includes a processor 810, memory 820, a display driver 830, a signal generator 840, an input/output (I/O) module 850, and a network/communications module 860. These components are in electrical communication with one another (e.g., via a signal bus) and with actuator 210.

Processor 810 may be implemented as any electronic device capable of processing, receiving, or transmitting data or instructions. For example, processor 810 can be a microprocessor, a central processing unit (CPU), an application-specific integrated circuit (ASIC), a digital signal processor (DSP), or combinations of such devices.

Memory 820 has various instructions, computer programs or other data stored thereon. The instructions or computer programs may be configured to perform one or more of the operations or functions described with respect to the mobile device. For example, the instructions may be configured to control or coordinate the operation of the device's display via display driver 830, waveform generator 840, one or more components of I/O module 850, one or more communication channels accessible via network/communications module 860, one or more sensors (e.g., biometric sensors, temperature sensors, accelerometers, optical sensors, barometric sensors, moisture sensors and so on), and/or actuator 210.

Signal generator 840 is configured to produce AC waveforms of varying amplitudes, frequency, and/or pulse profiles suitable for actuator 210 and producing acoustic and/or haptic responses via the actuator. Although depicted as a separate component, in some embodiments, signal generator 840 can be part of processor 810. In some embodiments, signal generator 840 can include an amplifier, e.g., as an integral or separate component thereof.

Memory 820 can store electronic data that can be used by the mobile device. For example, memory 820 can store electrical data or content such as, for example, audio and video files, documents and applications, device settings and user preferences, timing and control signals or data for the various modules, data structures or databases, and so on. Memory 820 may also store instructions for recreating the various types of waveforms that may be used by signal generator 840 to generate signals for actuator 210. Memory 820 may be any type of memory such as, for example, random access memory, read-only memory, Flash memory, removable memory, or other types of storage elements, or combinations of such devices.

As briefly discussed above, electronic control module 800 may include various input and output components represented in FIG. 8 as I/O module 850. Although the components of I/O module 850 are represented as a single item in FIG. 8, the mobile device may include a number of different input components, including buttons, microphones, switches, and dials for accepting user input. In some embodiments, the components of I/O module 850 may include one or more touch sensor and/or force sensors. For example, the mobile device's display may include one or more touch sensors and/or one or more force sensors that enable a user to provide input to the mobile device.

Each of the components of I/O module 850 may include specialized circuitry for generating signals or data. In some cases, the components may produce or provide feedback for application-specific input that corresponds to a prompt or user interface object presented on the display.

As noted above, network/communications module 860 includes one or more communication channels. These communication channels can include one or more wireless interfaces that provide communications between processor 810 and an external device or other electronic device. In general, the communication channels may be configured to transmit and receive data and/or signals that may be interpreted by instructions executed on processor 810. In some cases, the external device is part of an external communication network that is configured to exchange data with other devices. Generally, the wireless interface may include, without limitation, radio frequency, optical, acoustic, and/or magnetic signals and may be configured to operate over a wireless interface or protocol. Example wireless interfaces include radio frequency cellular interfaces, fiber optic interfaces, acoustic interfaces, Bluetooth interfaces, Near Field Communication interfaces, infrared interfaces, USB interfaces, Wi-Fi interfaces, TCP/IP interfaces, network communications interfaces, or any conventional communication interfaces.

In some implementations, one or more of the communication channels of network/communications module 860 may include a wireless communication channel between the mobile device and another device, such as another mobile phone, tablet, computer, or the like. In some cases, output, audio output, haptic output or visual display elements may be transmitted directly to the other device for output. For example, an audible alert or visual warning may be transmitted from the electronic device 100 to a mobile phone for output on that device and vice versa. Similarly, the network/communications module 860 may be configured to receive input provided on another device to control the mobile device. For example, an audible alert, visual notification, or haptic alert (or instructions therefor) may be transmitted from the external device to the mobile device for presentation.

The actuator technology disclosed herein can be used in panel audio systems, e.g., designed to provide acoustic and/or haptic feedback. The panel may be a display system, for example based on OLED of LCD technology. The panel may be part of a smartphone, tablet computer, television set, or wearable devices (e.g., smartwatch or head-mounted device, such as smart glasses). In some embodiments, the actuator technology is included in panel audio speakers that include a panel that does not include an electronic display panel, such as a window pane or a hi-fi speaker.

Other embodiments are in the following claims.

What is claimed is:

1. A system, comprising:

a panel extending in a plane;

an actuator attached to a surface of the panel, the actuator comprising:

a plate adapted to create a force to cause vibration of the panel to generate sound waves, the plate having a width, $W_T$, along a first direction at a first edge of the plate and a length, $L_T$, along a second direction orthogonal to the first direction, the first and second directions being parallel to the plane, the plate extending along the second direction from a first end to a second end, a stub extending from the first edge of the plate, the stub having a width, $W_S$, in the first direction at a region of connection to the plate at the first end of the plate that is less than $W_T$, the stub being attached to the surface of the panel to transfer the force received from the plate through to the panel and cause the panel to vibrate, and a damper supported by a surface of the plate facing the panel, the damper coupling the plate to the panel, the damper having a having a width, $W_D$, extending in the first direction by an amount greater than $W_S$; and an electronic control module in electrical communication with the actuator and programmed to activate the actuator during operation of the system to cause the vibration of the panel.

2. The system of claim 1, wherein the force created by the plate includes a fundamental resonance peak at a first frequency, $F_0$, a first resonance peak at a first frequency, $F_1$, and a second resonance peak at a second frequency, $F_2$, wherein an output of the plate is increased for at least some frequencies between $F_1$ and $F_2$ compared to the same plate but for which $W_D$ is the same as $W_S$.

3. The system of claim 2, wherein for at least one frequency between $F_1$ and $F_2$, the force created by the plate is at least 50 times greater compared to the same plate but for which $W_D$ is the same as $W_S$.

4. The system of claim 2, wherein $F_0$ is in a range from about 300 Hz to about 1 kHz and $F_1$ is in a range from about 3 kHz to about 8 kHz.

5. The system of claim 1, wherein a center point of the region of attachment of the stub to the plate is offset from a center point of the first edge of the plate.

6. The system of claim 1, wherein the region of connection of the stub to the first edge of the plate extends from a corner of the plate.

7. The system of claim 1, wherein $W_D$ is about 50% of $W_T$ or more.

8. The system of claim 1, wherein $W_D$ is about 80% of $W_T$ or more.

9. The system of claim 1, wherein the $W_D$ is substantially the same as $W_T$.

10. The system of claim 1, wherein $W_S$ is about 50% of $W_T$ or less.

11. The system of claim 1, wherein $W_S$ is about 35% of $W_T$ or less.

12. The system of claim 1, wherein the plate comprises a piezoelectric material.

13. The system of claim 1, wherein the actuator, at a second edge of the plate opposite the first edge, is unattached to the panel.

14. The system of claim 13, wherein the plate comprises a third edge extending along the second direction and a fourth edge opposite the third edge, wherein the actuator is unattached to the panel along the third and fourth edges.

15. The system of claim 1, wherein the surface of the plate faces the surface of the panel and extends parallel to the plane of the panel, and the stub comprises a portion that extends away from the surface of the plate along a third direction orthogonal to the first and second directions, the portion of the stub providing a separation between the surface of the plate and the surface of the panel.

16. The system of claim 15, wherein the damper has a thickness in the third direction substantially equal to the separation between the surface of the plate and the surface of the panel.

17. The system of claim 15, wherein the separation between the surface of the panel and the surface of the plate is in a range from about 0.2 mm to about 5 mm.

18. The system of claim 1, wherein the panel comprises an electronic display panel.

19. A distributed mode actuator, comprising:

a plate adapted to create a force to cause vibration of a load to generate sound waves, the plate having a width, $W_T$, along a first direction at a first edge of the plate and a length, $L_T$, along a second direction orthogonal to the first direction, the plate extending along the second direction from a first end to a second end;

a stub extending from the first edge of the plate, the stub having a width, $W_S$, in the first direction at a region of connection to the plate at the first end of the plate that is less than $W_T$, the stub being attachable to the load to transfer the force received from the plate through to the load and cause the load to vibrate; and a damper supported by a surface of the plate facing the load when the stub is attached to the load, the damper coupling the plate to the load, the damper having a having a width, $W_D$, extending in the first direction by an amount greater than $W_S$, the damper being formed from a material having viscoelastic properties to damp vibrations of the load.

20. A mobile device, comprising:

an electronic display panel extending in a plane;

a chassis attached to the electronic display panel and defining a space between a back panel of the chassis and the electronic display panel;

an electronic control module housed in the space, the electronic control module comprising a processor; and an actuator housed in the space and attached to a surface of the electronic display panel, the actuator comprising:

a plate adapted to create a force to cause vibration of the electronic display panel to generate sound waves, the plate having a width, $W_T$, along a first direction at a first edge of the plate and a length, $L_T$, along a second direction orthogonal to the first direction, the first and second directions being parallel to the plane, the plate extending along the second direction from a first end to a second end, a stub extending from the first edge of the plate, the stub having a width, $W_S$, in the first direction at a region of connection to the plate at the first end of the plate that is less than $W_T$, the stub being attached to the surface of the electronic display panel to transfer the force received from the plate through to the electronic display panel and cause the electronic display panel to vibrate, and a damper supported by a surface of the plate facing the electronic display panel, the damper coupling the plate to the electronic display panel, the damper having a having a width, $W_D$, extending in the first direction by an amount greater than $W_S$; and wherein the electronic control module is in electrical communication with the actuator and programmed to activate the actuator during operation of the mobile device to cause the vibration of the electronic display panel.

21. A system, comprising:

a panel extending in a plane;

an actuator attached to a surface of the panel, the actuator comprising:

a plate adapted to create a force to cause vibration of the panel to generate sound waves, the plate having a width, $W_T$, along a first direction at a first edge of the plate and a length, $L_T$, along a second direction orthogonal to the first direction, the first and second directions being parallel to the plane, the plate extending along the second direction from a first end to a second end, a stub extending from the first edge of the plate, the stub having a width, $W_S$, in the first direction at a region of connection to the plate at the first end of the plate that is less than $W_T$, the stub being attached to the surface of the panel to transfer the force received from the plate through to the panel and cause the panel to vibrate, and a damper supported by a surface of the plate facing the panel, the damper coupling the plate to the panel, the damper having a having a width, $W_D$, extending in the first direction by an amount greater than $W_S$, and wherein the damper has a length along the second direction, $L_D$, substantially less than $L_T$; and an electronic control module in electrical communication with the actuator and programmed to activate the actuator during operation of the system to cause the vibration of the panel.

* * * * *